US006222494B1

(12) United States Patent
Erkocevic

(10) Patent No.: US 6,222,494 B1
(45) Date of Patent: Apr. 24, 2001

(54) PHASE DELAY LINE FOR COLLINEAR ARRAY ANTENNA

(75) Inventor: Nedim Erkocevic, Nieuwegein (NL)

(73) Assignee: Agere Systems Guardian Corp., Miami Lakes, FL (US)

( * ) Notice: Subject to any disclaimer, the term of this patent is extended or adjusted under 35 U.S.C. 154(b) by 0 days.

(21) Appl. No.: 09/338,061

(22) Filed: Jun. 23, 1999

(30) Foreign Application Priority Data

Jun. 30, 1998 (EP) ..... 98305164

(51) Int. Cl.[7] ..... H01Q 9/04

(52) U.S. Cl. ..... 343/790; 343/792; 343/795; 343/727

(58) Field of Search ..... 343/790, 791, 343/792, 795, 793, 796, 725, 726, 702, 727, 729, 730; 333/146, 160, 161, 162, 163; H01Q 9/04

(56) References Cited

U.S. PATENT DOCUMENTS 3,585,534 6/1971 Senf ..... 333/29
5,387,919 * 2/1995 Lam et al. ..... 343/821
5,598,174 1/1997 Erkocevic et al. ..... 343/795
5,754,145 * 5/1998 Evans ..... 343/795

FOREIGN PATENT DOCUMENTS

WO 91/04588 4/1991 (WO) ..... H01P/5/18
WO 97/08772 3/1997 (WO) ..... H01P/1/18

* cited by examiner

*Primary Examiner*—Hoanganh Le

(57) ABSTRACT

A delay line, suitable for use as a feeder stage in an antenna array, comprises a single spiral revolution conductive strip formed on an insulating sheet. In one arrangement, the single spiral revolution conductive strip comprises first to fifth conductive strips connected end-to-end in series. The first and third conductive strips are positioned opposite each other, the third and fifth conductive strips are positioned opposite each other, and the second and fourth conductive strips are positioned opposite each other. The delay line finds particularly advantageous use in a collinear antenna array, particularly due to its very compact size.

9 Claims, 4 Drawing Sheets

PHASE DELAY LINE FOR COLLINEAR ARRAY ANTENNA

CROSS-REFERENCE TO RELATED APPLICATION

This application claims priority of European Patent Application No. 98305164.0, which was filed on Jun. 30, 1998.

FIELD OF THE INVENTION

The present invention relates to a delay line, and particularly but not exclusively to a feeding delay line in a collinear antenna array.

BACKGROUND OF THE INVENTION

In a wireless local area network (WLAN) a number of wireless access points (APs) form the wireless infrastructure, and wireless hosts communicate with each other via the wireless APs. The wireless hosts may be stationary or may roam around. Such a system is similar to any cellular network system.

A requirement for antennas at a wireless access point, or in a base station of a cellular network, is that the radiation must be omni-directional in the azimuth plane, in order to give an equal chance of access to all mobiles around it. There is a continuing desire for higher gain, omni-directional antennas, in particular for wireless APs, so as to extend the cell size in a cellular network and/or increase communication reliability of cells. However, such improvements need to be achieved whilst minimizing the cost, size and technical complexity of the antennas.

A good example of an omni-directional antenna is the well-known half wavelength dipole antenna which has a so-called "donut" shaped radiation pattern providing good omni-directional coverage. Such well-known half-wavelength dipole antenna's have a signal gain of 2 dBi, which can be insufficient for the desired large cell size/good communication reliability required or wireless AP antennas. A gain of 5 dBi can provide substantial improvements in omni-directional coverage.

The 2 dBi gain of a half-wavelength dipole antenna can be increased by "squashing" the "donut" radiation pattern across its vertical cross-section, thus changing it from the "donut" shape of a well-known half-wavelength dipole antenna to a "squashed donut", being flatter and larger in the azimuth plane.

Theoretically, such a pattern modification can be obtained, for example, by means of a couple of ordinary half-wavelength dipoles vertically stacked on top of each other to form a collinear array and fed in phase. However, the implementation of such an antenna can be troublesome primarily due to difficulties in arranging the feeding for the array elements in such a way as to avoid disturbing the radiation pattern. Known solutions to the problem of providing a feeding network in the collinear array add to the cost, size, or technical complexity of the antenna, which is undesirable.

It is therefore an object of the present invention to provide a feeding arrangement suitable for use in a collinear array antenna which can be implemented in a collinear array without unduly increasing the technical complexity thereof, which minimizes interference with the radiation pattern of the antenna, and which does not unduly add to the physical size of the antenna.

SUMMARY OF THE INVENTION

Thus, in one aspect of the present invention there is provided a delay line formed on an insulating sheet and having an input and an output, and comprising a single spiral revolution conductive strip coupled between the input and output.

There is thus provided a compact delay line suitable for use in an antenna array feeder stage.

The single spiral revolution conductive strip may comprise in one preferable embodiment: first to fifth conductive strips connected end-to-end in series, the first and third conductive strips being opposite to one another, the third and fifth conductive strips being opposite to one another and the second and fourth conductive strips being opposite to one another. Preferably the first and third conductive strips are parallel, the third and fourth conductive strips are parallel, and the second and fourth conductive strips are parallel.

The end of the first conductive strip not connected to the second conductive strip may be connected to the input by a sixth conductive strip. The end of the fifth conductive strip not connected to the fourth conductive strip may be connected to the output by a seventh conductive strip.

The single spiral revolution strip may comprise in another preferable embodiment: a first conductive strip coupled at one end to the input; a second conductive strip connected at one end to the other end of the first conductive strip and orientated at approximately 90° thereto; a third conductive strip connected at one end to the other end of the second conductive strip and orientated at approximately 90° thereto in a direction opposite to that of the first conductive strip: a fourth conductive strip connected at one end to the other end of the third conductive strip and orientated at approximately 90° thereto in a direction opposite to that of the second conductive strip; and a fifth conductive strip connected at one end to the other end of the fourth conductive strip and orientated at approximately 90° thereto in a direction opposite to that of the third conductive strip, and coupled at the other end thereof to the output.

The first conductive strip may be coupled to the input by a sixth conductive strip connected at one end to the other end of the first conductive strip and orientated at approximately 90° thereto in a direction opposite to that of the second conductive strip. The fifth conductive strip may be coupled to the output by a seventh conductive strip connected at one end to the other end of the fifth conductive strip and at its other end to the output, and orientated at approximately 90° relative to the fifth conductive strip in a direction opposite to the fourth conductive strip.

The first to sixth conductive strips are preferably formed on a first side of the insulating sheet, and the seventh conductive strip (50) is preferably formed on a second side of the insulating sheet.

Preferably, the third conductive strip is longer than the first conductive strip, the fourth conductive strip is shorter than the second conductive strip, the fifth conductive strip is shorter than the third (44) conductive strip, and the output is located opposite the input (34).

The present invention further provides an antenna array comprising at least one feeder stage including a single spiral revolution conductive strip delay line.

In another aspect of the present invention there is provided a collinear antenna array formed on an insulating sheet comprising: a first end fed dipole antenna system for a radio frequency generator having an operating wavelength L, comprising: on a first side of an insulating sheet a first and a second quarter wavelength conductive strip in end-to-end connection; on a second side of the insulating sheet a third quarter wavelength conductive strip, overlying the first quarter wavelength conductive strip, a fourth quarter wavelength conductive strip having a longer arm spaced from and parallel to the third quarter wavelength conductive strip and a shorter arm connected to the third quarter wavelength conductive strip and a fifth quarter wavelength conductive strip having a longer arm spaced from and parallel to the third quarter wavelength conductive strip, symmetrical with the fourth quarter wavelength conductive strip, and a shorter arm connected to the third quarter wavelength conductive strip; and means to connect said radio frequency generator between the end of the third quarter wavelength conductive strip remote from the connection to the fourth quarter wavelength conductive strip, and the corresponding end of the first quarter wavelength conductive strip, whereby the second and fourth quarter wavelength conductive strips form a linear dipole antenna; wherein the collinear antenna array further comprises; a feeder stage including a delay line having an input and an output and a single spiral revolution conductive strip coupled therebetween, the delay line input being connected to the end of the second quarter wavelength conductive strip remote from the first quarter wavelength conductive strip; and a monopole comprising a conductive strip having one end connected to the output of the delay line.

There is thus provided a collinear antenna array having a simple feeding network implementation, and an overall smaller size due to the feeder arrangement provided by the delay line having a compact size.

The collinear antenna array may further comprise an auxiliary antenna orientated orthogonal to the collinear antenna array. Thereby selection antenna diversity is achieved by means of a small extra antenna. The auxiliary antenna may be a bent-notch antenna.

Brief Description of the Drawings

The invention will now be described with reference to a preferred embodiment with reference to the accompanying drawings, in which.

DETAILED DESCRIPTION

Figure 1:
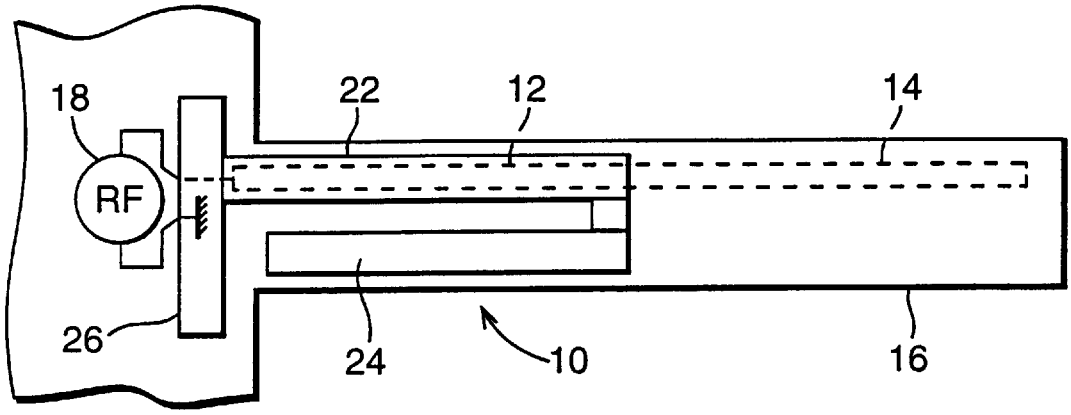
FIG. 1 (PRIOR ART)
FIG. 1 is a plan view of a printed sleeve antenna.
Figure 2:
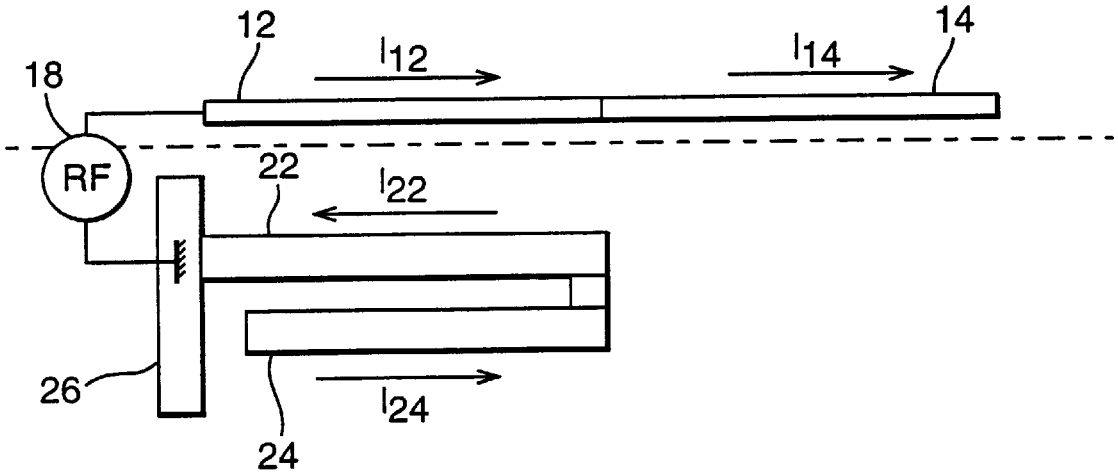
FIG. 2 (PRIOR ART)
FIG. 2 is a schematic illustrating the RF currents in the aprts of the antenna of FIG. 1.

Reference is now made to the drawings, in which like reference numerals identify similar or identical elements. FIGS. 1 and 2 illustrate an end fed dipole antenna system as described in U.S. Pat. No. 5,598,174. Such an end fed dipole antenna system utilizes a particularly advantageous feeding technique which provides an end fed dipole which operates as if it were center fed. The delay line according to the present invention can be combined with such an antenna to construct a compact collinear array antenna having high performance, as discussed hereafter.

FIG. 1 illustrates an antenna system, indicated generally as 10, which comprises first and second conductive strips 12, 14 formed on an insulating layer or sheet 16, such as a printed circuit board (PCB). Conductive strips 12, 14 are on the lower side of the PCB as viewed in FIG. 1, and are therefore shown in dashed outline. Each conductive strip is L/4 in length where L is the wavelength of operation, and the conductive strips are connected end-to-end. The end of conductive strip 12 which is remote from conductive strip 14 is connected to one side of a radio frequency (RF) generator 18 operating at the wavelength L.

On the upper side of the insulating layer 16 are third and fourth conductive strips 22, 24; conductive strip 22 is straight and of length L/4 and has one end connected to the other side of the RF generator 18. Conductive strip 24 is essentially "L" shaped, the longer arm of the L lying parallel to and spaced from conductive strip 22, and the shorter arm being connected to the opposite end of conductive strip 22 to that end of conductive strip 22 connected to the generator. Adjacent strips 22, 24 is a fifth conductive strip 26 perpendicular to the other four conductive strips. Conductive strip 26 is of relatively small size and provides a suitable connection for unbalanced feed means such as a coaxial feed cable (not shown) which connects the RF generator 18 to the antenna. It will be appreciated that with this arrangement, the provision of a true ground plane, which would need to be of much greater size than strip 26, is unnecessary. Conductive strip 22 overlies conductive strip 12, i.e., the conductive strips 22, 12 are in register but are separated by the thickness of PCB 16. PCB 16 advantageously follows the general elongated outline of the strips but is of slightly greater area.

In FIG.2, both sides of the PCB 16 are shown in a schematic view. Above the chain dashed line are conductive strips 12, 14, and below the chain dashed line are conductive strips 22, 24 and conductive strip 26. While conductive strips 12, 14 are shown to be thinner than conductive strips 22, 24, this is for clarity of illustration only; the conductive strips in practice may be of equal width.

It is well known in antenna theory that for optimum performance the RF currents in each arm of a linear dipole, e.g. that formed by conductive strips 12, 14, must be of equal amplitude and phase, that is the dipole must be balanced. This is easily achieved if the dipole is center fed from a balanced source. However, the dipole often has to be connected to an unbalanced source (e.g. a coaxial cable or a microstrip line) which creates the need for a balun. Moreover the RF signal has to be brought to the center of the dipole (i.e. the junction between conductive strips 12 and 14) in a way that will not disturb the RF current distribution in the dipole itself.

The placement of conductive strip 22 underneath conductive strip 12 forms a transmission line that transfers the signal from the RF generator 18 to the junction of conductive strips 12 and 14. Therefore the RF currents $I_{12}$ and $I_{22}$, in conductive strips 12 and 22 respectively, are of equal amplitude and opposite phase. In such an arrangement, conductive strip 14 attached to conductive strip 12 can be regarded as a L/4 monopole with respect to the virtual ground positioned at the end of conductive strip 22 underneath the junction of conductive strips 12 and 14. It can be assumed that the RF generator has moved to the other end of the line formed by conductive strips 12, 22 and has one of its outputs connected to conductive strip 14 and the other floating. In order to ensure that the arrangement operates as a monopole (which is by definition an unbalanced antenna) fed from an unbalanced RF source 18, the effect of a ground plane has to be present and the other (floating) end of the RF generator 18 has to be connected to it. This results in the injecting into this ground plane of an RF current, equal in amplitude and opposite in phase to the RF current 114 in conductive strip 14.

The effect of the presence of an infinite ground plane (ideal current sink) at this point (i.e. at the end of conductive strip 22 positioned below the junction of conductive strips 12 and 14) is achieved by placing conductive strip 24 parallel to conductive strip 22 and connecting it to conductive strip 22 (at the junction of strips 12 and 14). The L/4 length of conductive strip 24 forms, with respect to strip 22, an open quarter wavelength transmission line and therefore, as seen by monopole 14 (and transferred RF generator 18) appears as an infinitely large ground plane since conductive strip 24 is terminated at a position of zero current and maximum voltage of the standing wave. The result is that the RF currents $I_{24}$ and $I_{14}$, in conductive strips 24 and 14 respectively, are of equal amplitude and orientation, as in the case of a center fed dipole, while the unbalanced RF generator 18 appears to feed unbalanced monopole antenna 14, through a microstrip line formed by conductive strips 12, 22. The RF currents $I_{12}$ and $I_{22}$ cancel out each other in terms of radiation, while currents $I_{14}$ and $I_{24}$ act together as a center fed dipole. More precisely the currents in conductive strips 14 and 24 are distributed in the same way as in the arms of a center fed dipole, creating its effect of a true dipole-like radiation pattern. Although the system operates as if it were center fed, the dipole 14, 24 is in fact end fed (through line 12, 22), and thus has the convenience of an end fed antenna.

If a physical ground plane is provided at the end of conductive strip 22, closer to the actual location of the RF generator 18 (e.g. conductive strip 26), it will be almost free of (unbalanced) ground currents since these are redirected to strip 24, effectively radiating associated energy to the air. This feature of antenna 10 that prevents the occurrence of unbalanced ground currents on the ground plane associated to the antenna feeding point, is important for hand held radio devices since it can lead to significant improvements in RF efficiency.

In the preferred embodiment of the present invention, the end-fed dipole antenna of U.S. Pat. No. 5,598,174 described hereinabove with reference to FIGS. 1 and 2 is modified and used as part of a collinear array antenna. The end-fed dipole antenna of FIGS. 1 and 2 is modified, as shown in FIG. 3 and described further hereinafter, in order to improve the symmetry of the radiation pattern, which feature becomes more important in constructing an antenna array.

Figure 3:
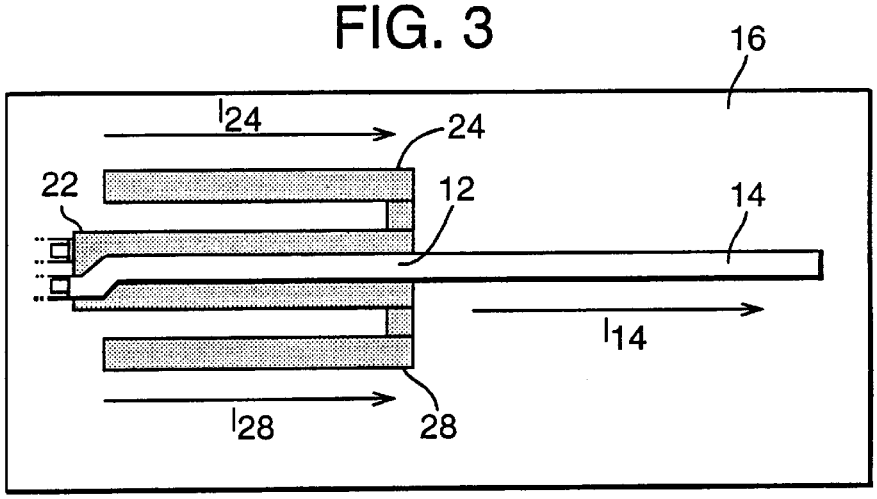
FIG. 3 is a plan view of a modified printed sleeve antenna also illustrating the RF currents therein.

In FIG. 3 elements which correspond to elements shown in FIGS. 1 and 2 are identified by like reference numerals. FIG. 3 shows the PCB 16 from the opposite side shown in FIG. 1, i.e. the underside. The grey areas are on the upperside of the PCB and the white (or clear) areas on the underside the underside being visible in FIG. 3. FIG. 3 shows the first and second conductive strips 12 and 14, and the third and fourth conductive strips 22, 24. In addition a sixth conductive strip 28 is provided, essentially "L"-shaped and symmetrical with conductive strip 24 about conductive strips 12 and 22.

The provision of strip 28, symmetric to strip 24, improves the symmetry of the radiation pattern of the printed sleeve antenna. In operation an RF current $I_{28}$ flows in conductive strip 28. To ensure the radiation pattern of the antenna in FIG. 3 is omnidirectional and maximized in the azimuth plane, the RF currents $I_{14}$, $I_{24}$ and $I_{28}$ must be in phase.

Figure 4:
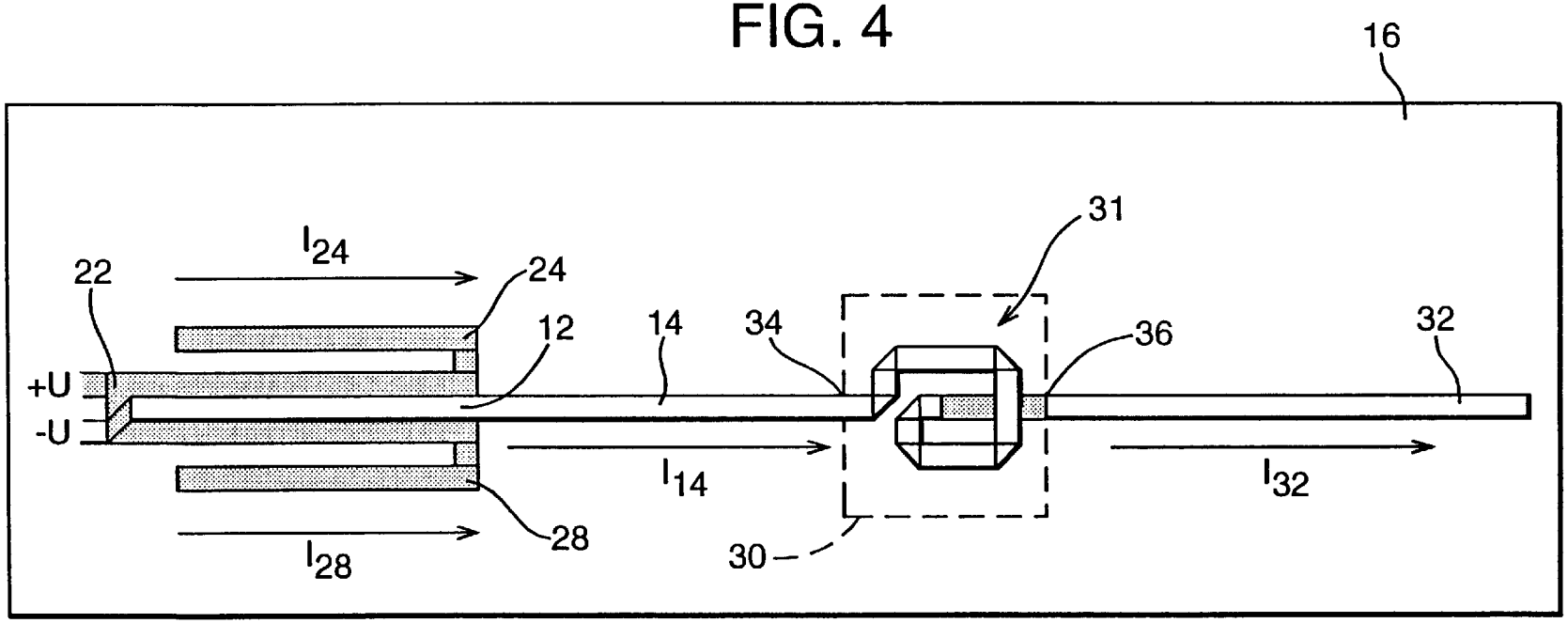
FIG. 4 is a plan view of a collinear antenna array including the modified printed sleeve antenna of FIG. 3 and a phase delay line according to the present invention.

FIG. 4 illustrates how the adapted end-fed dipole antenna of FIG. 3 is further modified to form a collinear array incorporating a delay line in accordance with the present invention. Once again, like reference numerals denote like elements.

The end of the conductive strip 14 remote from the conductive strip 12 is connected through an interconnection comprising a delay stage 30 to a conductive strip 32 of length L/2 forming a half-wavelength monopole. The delay stage, or delay line 30 acts as a feeder delay stage in the arrangement of FIG. 4.

In order for the antenna of FIG. 4 to operate as a collinear array, the delay stage 30 must let approximately half of the total incident RF power from the RF source 18 be fed directly to the top element 32 of the collinear array. This is required to achieve a desired gain of 5 dBi, which is approximately twice the half-wavelength dipole power gain of 2 dBi.

The delay stage 30 must also delay the RF current supplied to the top element 32 of the collinear array by 180°, because only then will the RF currents $I_{14}$ and $I_{32}$, in conductive strips 14 and 32 respectively, be in phase. The RF currents $I_{14}$, $I_{24}$, $I_{28}$ and $I_{32}$ must all be in phase to maximize the radiation pattern in the azimuth plane and ensure the desired 5 dBi power gain.

Figure 5:
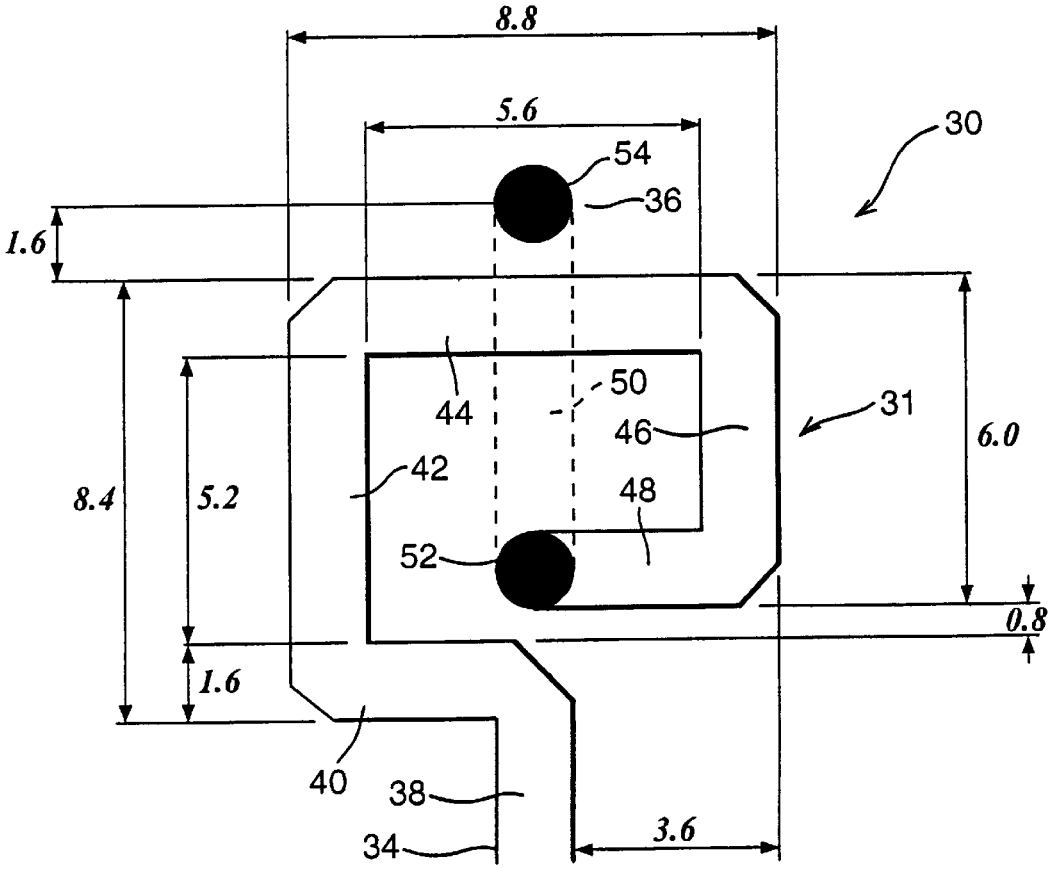
FIG. 5 is as detailed view of the phase delay line of FIG. 4.

The delay stage 30 according to the preferred embodiment of the present invention is shown in greater detail in FIG. 5. The specific arrangement of the delay stage 30 shown in FIG. 5 is for the specific implementation of the collinear array as discussed hereinabove, and this specific implementation is presented for illustrative purposes only to facilitate an explanation of the present invention. As discussed hereinafter, the delay stage of the specific embodiment may be modified and adapted according to the desired application, whilst still applying the principals of the present invention.

As illustrated in both FIGS. 4 and 5, the delay stage 30 has an input 34 and an output 36. The delay stage input 34 is connected to the end of the conductive strip 14 remote from the conductive strip 12, and the delay stage output 36 is connected to one end of the conductive strip 32 forming the half-wavelength monopole.

The delay stage 30 comprises a conductive strip, generally designated as 31, which is formed in a single spiral revolution. That is, the single spiral revolution conductive strip 31 turns completely, once, through 360°. The single spiral revolution conductive strip 31 is comprised of five conductive strips connected end-to-end in series which are shaped to form the single spiral revolution The single spiral revolution conductive strip 31 comprises a first conductive strip 40, a second conductive strip 42, a third conductive strip 44, a fourth conductive strip 46, and a fifth conductive strip 48.

The first 40, second 42, third 44, fourth 46 and fifth 48 conductive strips are arranged such that the first 40 and third 44 conductive strips are substantially parallel and opposite to one another, the third 44 and fifth 48 conductive strips are substantially parallel and opposite to one another, and so that the second and fourth conductive strip 42 and 46 are substantially parallel and opposite to one other, the first to fifth conductive strips thereby forming a single spiral revolution conductive strip 31.

By positioning the first conductive strip approximately parallel to the third conductive strip, the third conductive strip approximately parallel to the fifth conductive strip, and the second conductive strip approximately parallel to the fourth conductive strip, the RF currents in the respective conductive strips cancel each other out in terms of electromagnetic radiation, which is essential for the correct operation of the delay stage. Although ideally the respective conductive strips should be precisely parallel, it will be appreciated by one skilled in the art that an imperfect arrangement of the first to fifth conductive strips may still enable the delay stage 30 to operate within acceptable tolerances for the application.

In the preferred embodiment of FIGS. 4 and 5, the delay stage 30 thus comprises a conductive strip comprising a first conductive strip 40 coupled at one end to the delay stage input, a second conductive strip 42 connected at one end to the other end of the first conductive strip 40 and orientated at approximately 90° thereto, a third conductive strip 44 connected at one end to the other end of the second conductive strip 42 and orientated at approximately 90° thereto in a direction opposite to the first conductive strip 40, a fourth conductive strip 46 connected at one end to the other end of the third conductive strip 44 and orientated at approximately 90° thereto in a direction opposite to that of the second conductive strip 42, and a fifth conductive strip 48 connected at one end to the other end of the fourth conductive strip and orientated at 90° thereto in a direction opposite to that of the third conductive strip 44, the other end of the fifth conductive strip 48 being coupled to the output 36 of the delay stage 30.

The third conductive strip 44 is preferably approximately equal in length to the combined length of the first 40 and fifth 48 conductive strips to achieve ideal current balancing. Similarly the fourth conductive strip 46 is approximately equal in length to the second conductive strip 42. However in practice, to achieve the single spiral revolution shape, the fourth conductive strip 46 is shorter than the second conductive strip 42.

In the preferred embodiment of the present invention, the first conductive strip 40 is coupled to the input 34 of the delay stage 30 by a sixth conductive strip 38, which is preferably orientated at approximately 90° to the first conductive strip 40 in a direction opposite to the second conductive strip 42. In such preferred embodiment, the first to fifth conductive strips 40 to 48 are formed on one side of the insulating sheet together with the sixth conductive strip 38. A seventh conductive strip 50 is provided on the other side of the insulating sheet, and couples the fifth conductive strip 48 to the output 36 of the delay stage 30. The seventh conductive strip 50 is connected to the fifth conductive strip 48 by a via 52 through the insulating sheet 16. The insulating sheet is preferably also provided with a via 54 to couple the end of the seventh conductive strip 50 connected to the output of the delay stage to the conductive strip 32 on the first side of the insulating sheet forming the half wavelength monopole.

It will be appreciated that, in an alternative arrangement, the seventh conductive strip 50 may be formed on the first side of the insulating layer and the third conductive strip 44 formed on the second side of the insulating layer, interconnections being provided to connect the appropriate ends of the second 42 and fourth 46 conductive strips.

FIG. 5 shows the dimensions, in millimeters, of the preferred implementation of the delay stage 30 of the invention for application in the collinear array of FIG. 4, wherein a 180° phase delay and 50% power feed is required at a frequency of operation of 2.4 to 2.5 GHz.

It will be appreciated by one skilled in the art that the single spiral revolution conductive strip delay line of the present may be utilized in antenna arrays requiring multiple feeds. For example in a collinear array having three antennas two feeder delay stages are required. The first feeder delay stage feeding ⅔ of the total incident RF power to the second and third antennas of the array, and the second feeder delay stage feeding ½ of the ⅔ power fed to the third antenna of the array.

Thus it will be appreciated by one skilled in the art that the specific dimensions of the single spiral revolution conductive strip delay line can be experimented with to achieve the required performance characteristics (phase delay, power feed) for a particular application whilst maintaining the single spiral revolution shape.

Figure 6:
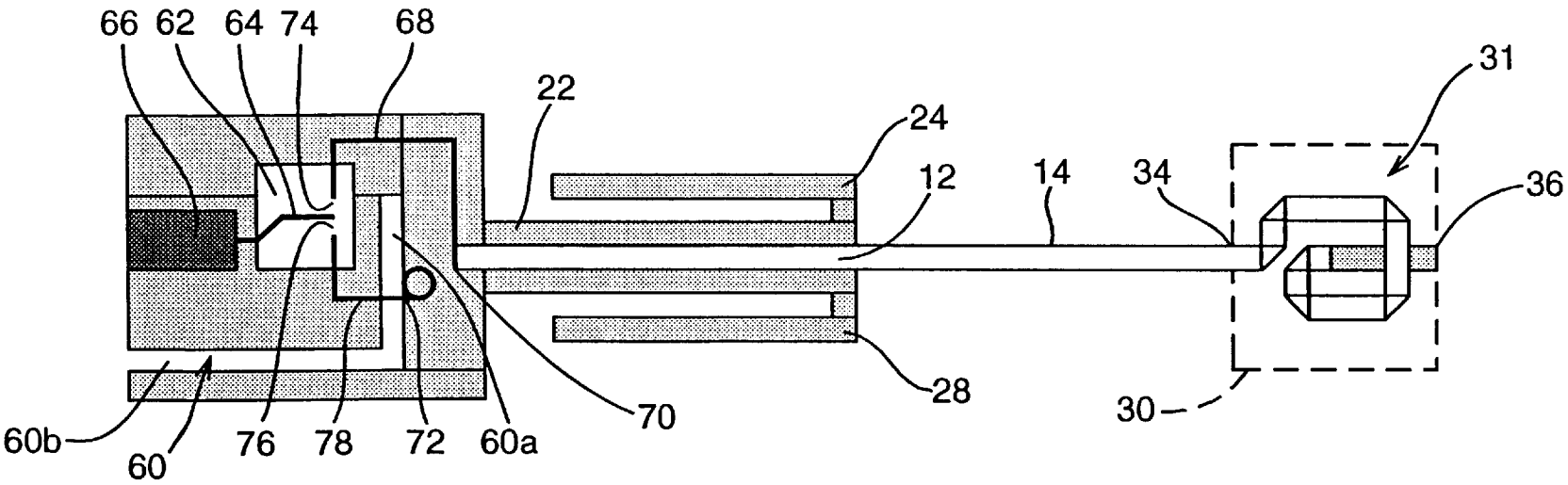
FIG. 6 is a plan view of the collinear antenna array of FIG. 4 with an auxiliary antenna.

In a further modification, the collinear array of FIG. 4 is adapted to include an extra antenna on the insulating sheet 16 thereby to provide a means for selection antenna diversity. FIG. 6 shows a bent notch antenna implemented in the small ground plane 26 of the collinear array. Once again, like reference numerals are used in FIG. 6 for elements corresponding to elements shown in other figures. The half wave monopole formed by conductive strip 32 is not shown in FIG. 6 for reasons of clarity.

The bent notch antenna is indicated generally by numeral 60 in FIG. 6 and is represented diagrammatically by the white 'L -shape' gap in the shading representing the ground plane 26 formed on the underside of the insulating layer. The bent notch antenna 60 comprises two portions 60*a* and 60*b* forming the 'L-shape'. The bent notch antenna 60 is an ordinary notch antenna bent into two sections in order to reduce the occupied surface. The total length of the notch in the specific application of FIG. 6 is approximately L/4, L being the operating wavelength. An antenna diversity switch 62 is also provided in the ground plane 26, and receives the RF feed to the antenna system from a cable attachment 66. The feeding line "enters" the notch at such a point that the input impedance is close to 50 ohm. The antenna diversity switch is an SPDT (single pole double terminal), low distortion switch.

The antenna diversity switch 62 includes a switch connection 64 which can switch between two switch contacts 74 and 76. Switch contact 74 provides the RF feed via a microstrip line 68 to the colliner antenna discussed hereinabove, and switch contact 76 provides the RF feed via microstrip line 78 to the notch antenna 60. The microstrip line 78 is connected to the bent notch antenna feeding point.

The specific implementation of the bent notch antenna in the ground plane of the collinear array antenna to provide an auxiliary antenna to thereby give selection antenna diversity will be within the skills of one knowledgeable in the art. The provision of the bent notch antenna as the auxiliary antenna provides a compact collinear antenna array having selection antenna diversity.

Whereas the collinear array both transmits and receives, the addition of a notch antenna provides an auxiliary antenna for receiving only. As the auxiliary antenna is not used for transmission, then it is not required to have the careful design and high power gain of the collinear array.

The provision of the auxiliary antenna enables the antenna system to provide selection antenna diversity. As is well-known, antenna diversity switching circuitry is provided to enable the auxiliary antenna to be switched on when the signal received by the collinear array is weak.

What is claimed is:

1. A collinear antenna array formed on an insulating sheet comprising:

a first end fed dipole antenna system for a radio frequency generator having an operating wavelength L, comprising:

on a first side of an insulating sheet a first and a second quarter wavelength conductive strip in end-to-end connection;

on a second side of the insulating sheet a third quarter wavelength conductive strip, overlying the first quarter wavelength conductive strip, a fourth quarter wavelength conductive strip having a longer arm spaced from and parallel to the third quarter wavelength conductive strip and a shorter arm connected to the third quarter wavelength conductive strip, and a fifth quarter wavelength conductive strip having a longer arm spaced from and parallel to the third quarter wavelength conductive strip, symmetrical with the fourth quarter wavelength conductive strip, and a shorter arm connected to the third quarter wavelength conductive strip; and means to connect said radio frequency generator between the end of the third quarter wavelength conductive strip remote from the connection to the fourth quarter wavelength conductive strip, and the corresponding end of the first quarter wavelength conductive strip, whereby the second and fourth quarter wavelength conductive strips form a linear dipole antenna; wherein the collinear antenna array further comprises:

a feeder stage including a delay line having its input connected to the end of the second quarter wavelength conductive strip remote from the first quarter wavelength conductive strip; and a monopole comprising a conductive strip having one end connected to the output of the delay line.

2. A collinear antenna array according to claim 1 further comprising an auxiliary antenna orientated orthogonal to the collinear antenna array.

3. A collinear antenna array according to claim 1 wherein the delay line comprises a single spiral revolution conductive strip coupled between the input and output.

4. A collinear antenna array according to claim 3, wherein the single spiral revolution conductive strip comprises:

first to fifth conductive strips connected end-to-end in series, the first and third conductive strips being opposite to one another, the third and fifth conductive strips being opposite to one another, and the second and fourth conductive strips being opposite to one another.

5. A collinear antenna array according to claim 4, wherein the end of the first conductive strip not connected to the second conductive strip is connected to the input by a sixth conductive strip and the end of the fifth conductive strip not connected to the fourth conductive strip is connected to the output by a seventh conductive strip.

6. A collinear antenna array according to claim 5, wherein the first to sixth conductive strips are formed on a first side of the insulating sheet, and the seventh conductive strip is formed on a second side of the insulating sheet.

7. A collinear array according to claim 4, in which the third conductive strip is longer than the first conductive strip, the fourth conductive strip is shorter than the second conductive strip, the fifth conductive strip is shorter than the third conductive strip, and the output is located opposite the input.

8. A collinear antenna array according to claim 3, wherein the single spiral revolution strip comprises:

a first conductive strip coupled at one end to the input;

a second conductive strip connected at one end to the other end of the first conductive strip and orientated at approximately 90° thereto;

a third conductive strip connected at one end to the other end of the second conductive strip and orientated at approximately 90° thereto in a direction opposite to that of the first conductive strip;

a fourth conductive strip connected at one end to the other end of the third conductive strip and orientated at approximately 90° thereto in a direction opposite to that of the second conductive strip; and a fifth conductive strip connected at one end to the other end of the fourth conductive strip and orientated at approximately 90° thereto in a direction opposite to that of the third conductive strip, and coupled at the other end thereof to the output.

9. A collinear antenna array according to claim 8, wherein the first conductive strip is coupled to the input by a sixth conductive strip connected at one end to the other end of the first conductive strip and orientated at approximately 90° thereto in a direction opposite to that of the second conductive strip, and wherein the fifth conductive strip is coupled to the output by a seventh conductive strip connected at one end to the other end of the fifth conductive strip and at its other end to the output, and orientated at approximately 90° relative to the fifth conductive strip in a direction opposite to the fourth conductive strip.

* * * * *